US006517034B1

(12) United States Patent
Kinchen

(10) Patent No.: US 6,517,034 B1
(45) Date of Patent: Feb. 11, 2003

(54) BAG OPENING AND CLEANING SYSTEM

(76) Inventor: Harriet Kinchen, 14707 S. Lime Ave., Compton, CA (US) 90221

( * ) Notice: Subject to any disclaimer, the term of this patent is extended or adjusted under 35 U.S.C. 154(b) by 0 days.

(21) Appl. No.: 10/015,230

(22) Filed: Dec. 12, 2001

(51) Int. Cl.[7] ..... B65B 67/12

(52) U.S. Cl. ..... 248/99; 248/100; 248/101; 383/33

(58) Field of Search ..... 248/95, 99, 100, 248/101; 141/390, 391; 383/33; 15/257.1, 257.3, 257.4, 257.8, 257.9

(56) References Cited

U.S. PATENT DOCUMENTS 895,759 A * 8/1908 Hulbert ..... 248/100
3,711,141 A * 1/1973 Soergel ..... 15/257.8
4,238,868 A * 12/1980 Sternberg ..... 15/257.4
4,759,519 A * 7/1988 Cheng ..... 248/125.3
5,004,195 A * 4/1991 McIntyre ..... 15/257.9
5,014,943 A * 5/1991 Nelson et al. ..... 141/316
5,033,703 A * 7/1991 Allen, Sr. ..... 248/175
5,040,754 A * 8/1991 Dearman ..... 15/257.4
5,082,219 A * 1/1992 Blair ..... 141/390
5,316,060 A * 5/1994 Hodgdon et al. ..... 141/108
5,413,394 A * 5/1995 Mitchell ..... 15/257.7
5,570,862 A * 11/1996 Nugent ..... 248/101
5,718,469 A * 2/1998 Ockerman ..... 248/101
5,913,496 A * 6/1999 Valdez ..... 24/461
5,947,602 A * 9/1999 Coxsey ..... 248/99
6,017,069 A * 1/2000 Imms et al. ..... 248/101
6,086,022 A * 7/2000 Dalton ..... 248/101

* cited by examiner

*Primary Examiner*—Leslie A. Braun
*Assistant Examiner*—Deborah M. Brann
(74) *Attorney, Agent, or Firm*—Goldstein & Lavas, P.C.

(57) ABSTRACT

A bag opening and cleaning system which allows a garbage or leaf bag to be held open while filled with garbage or leaves. The system includes a pair of hoops including an inner hoop and an outer hoop. The inner hoop is positionable within the outer hoop. The pair of hoops have a plurality of circumferentially spaced pliable clamps holding the inner and outer hoops together. The pair of hoops receive an open upper end of a bag between the inner and outer hoops. A gripping member is coupled with the pair of hoops. A dust pan is hingedly coupled with the pair of hoops.

5 Claims, 6 Drawing Sheets

BAG OPENING AND CLEANING SYSTEM

BACKGROUND OF THE INVENTION

The invention relates to a bag opening and cleaning system which allows a garbage or leaf bag to be held open while filled with garbage or leaves.

When people are attempting to dispose of garbage and leaves into a bag, they are often confronted with the problem of keeping the bag in an open orientation with one hand while trying to direct the garbage or leaves into the bag with their other hand. This is typically a difficult procedure, often resulting in the creation of a larger mess. One approach to this problem is the involvement of an additional person used to hold the bag open while the other person deposits the garbage or leaves into the bag. Other devices have been created that will hold bags open. These bags, however, do not include the features of the present invention which also incorporates a dust pan and an extension handle which help to aid a person in the cleaning process.

While these units used for holding bags in an open orientation may be suitable for the particular purpose employed, or for general use, they would not be as suitable for the purposes of the present invention as disclosed hereafter.

SUMMARY OF THE INVENTION

It is an object of the invention to produce a bag opening and cleaning system which allows a garbage or leaf bag to be held open while filled with garbage or leaves including a pair of hoops including an inner hoop and an outer hoop. The inner hoop is positionable within the outer hoop. The pair of hoops are expandable to varying diameters. The pair of hoops have a slide member coupled thereto. The slide member holds the pair of hoops at a fixed diameter. The pair of hoops have a plurality of circumferentially spaced pliable clamps holding the inner and outer hoops together. The pair of hoops receive an open upper end of a bag between the inner and outer hoops. A gripping member is coupled with the pair of hoops. The gripping member has a cylindrical collar extending laterally therefrom. The cylindrical collar has an internally threaded open upper end. The gripping member includes an elongated handle couplable with the cylindrical collar. The elongated handle has a threaded lower end for mating with the internally threaded open upper end of the cylindrical collar. A dust pan is hingedly coupled with the pair of hoops. The dust pan is diametrically opposed from the gripping member. The dust pan has a free planar lower edge for positioning on a recipient surface.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

It will be noted in the various figures that the device relates to a bag opening and cleaning system which allows a garbage or leaf bag to be held open while filled with garbage or leaves. In its broadest context, the device consists of a pair of hoops, a gripping member, and a dust pan. Such components are individually configured and correlated with respect to each other so as to attain the desired objective.

Figure 1:
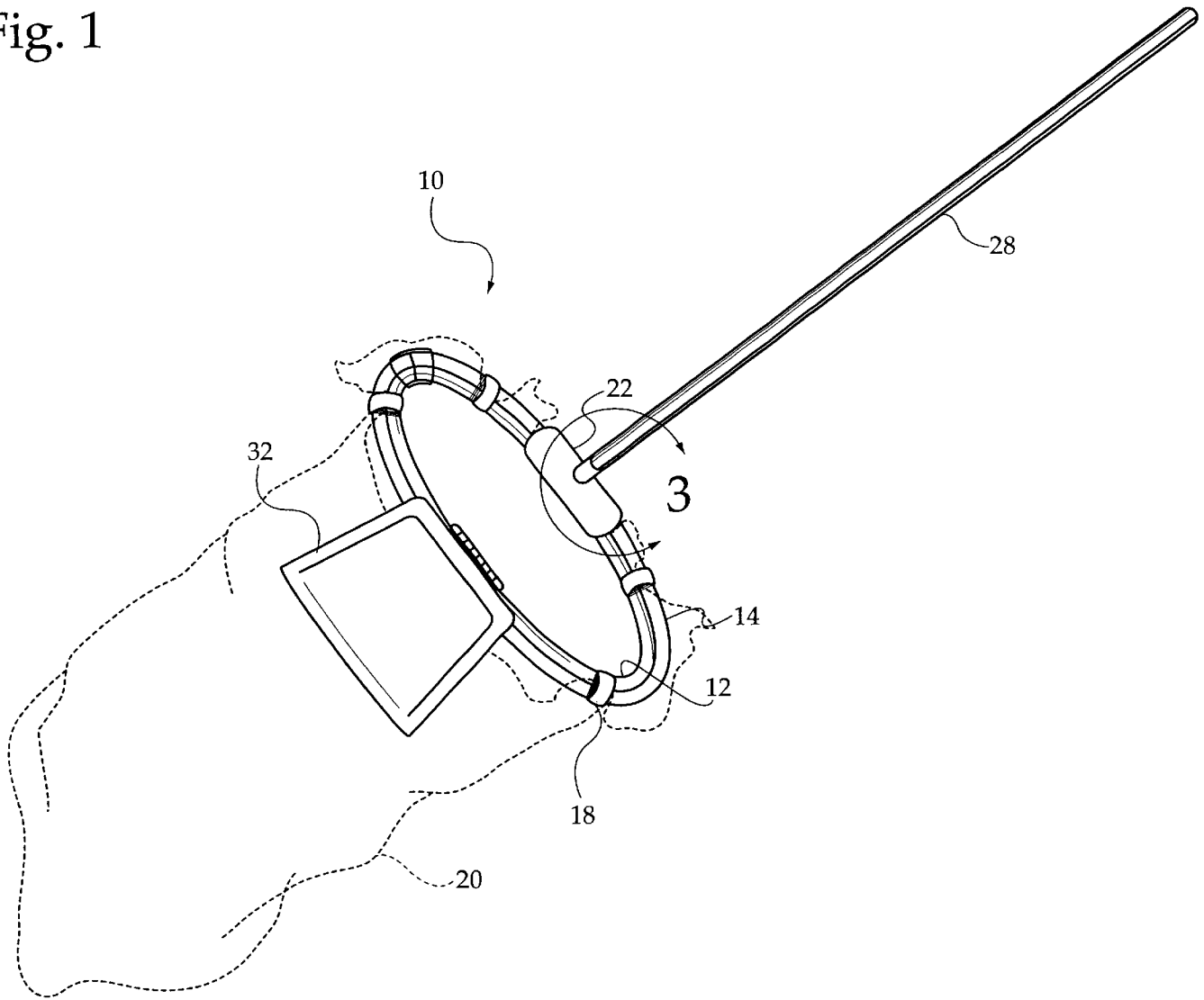
FIG. 1 is a perspective view of the present invention illustrated in use.
Figure 2:
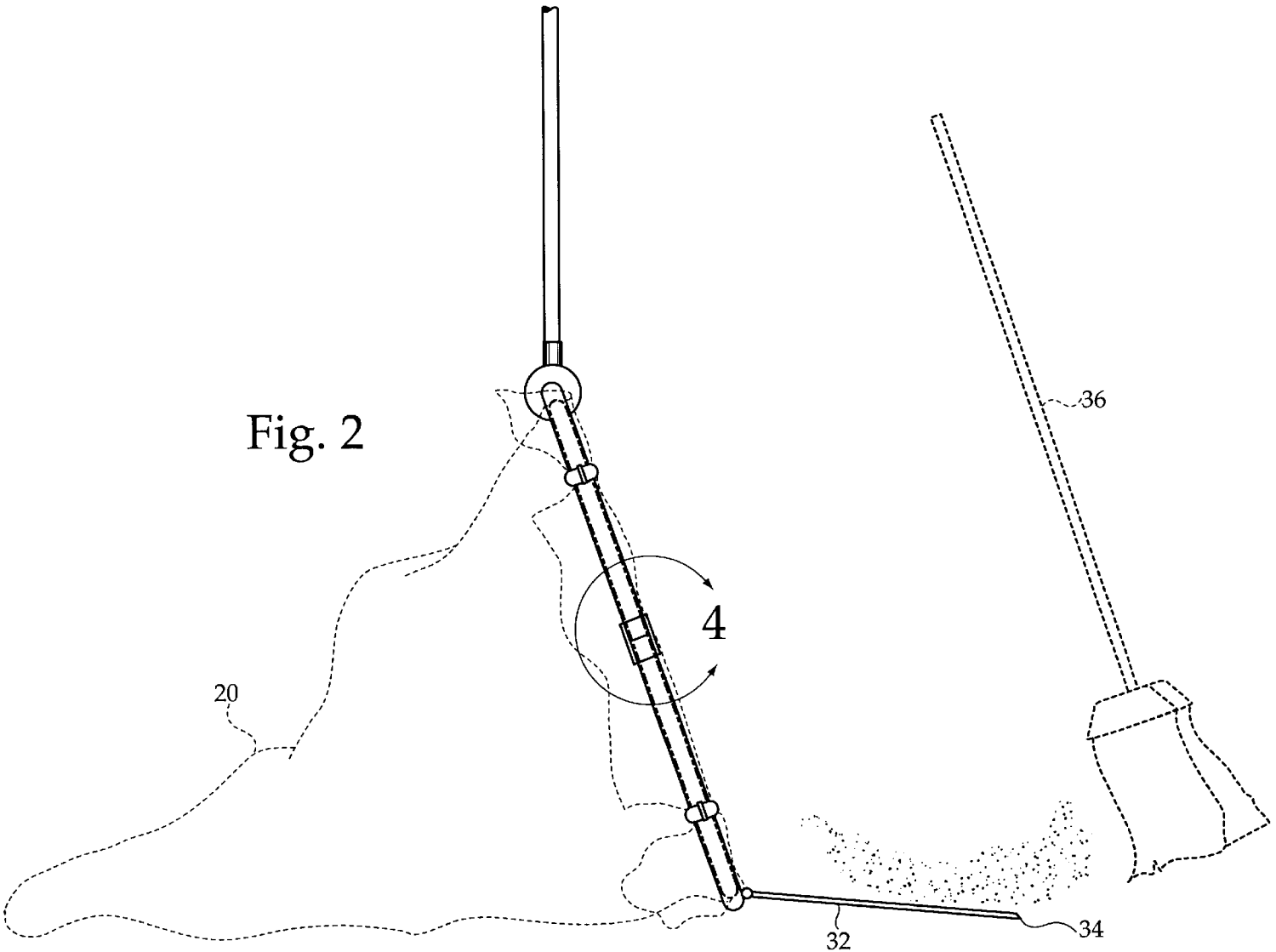
FIG. 2 is a side view of the present invention illustrated in use.
Figure 3:
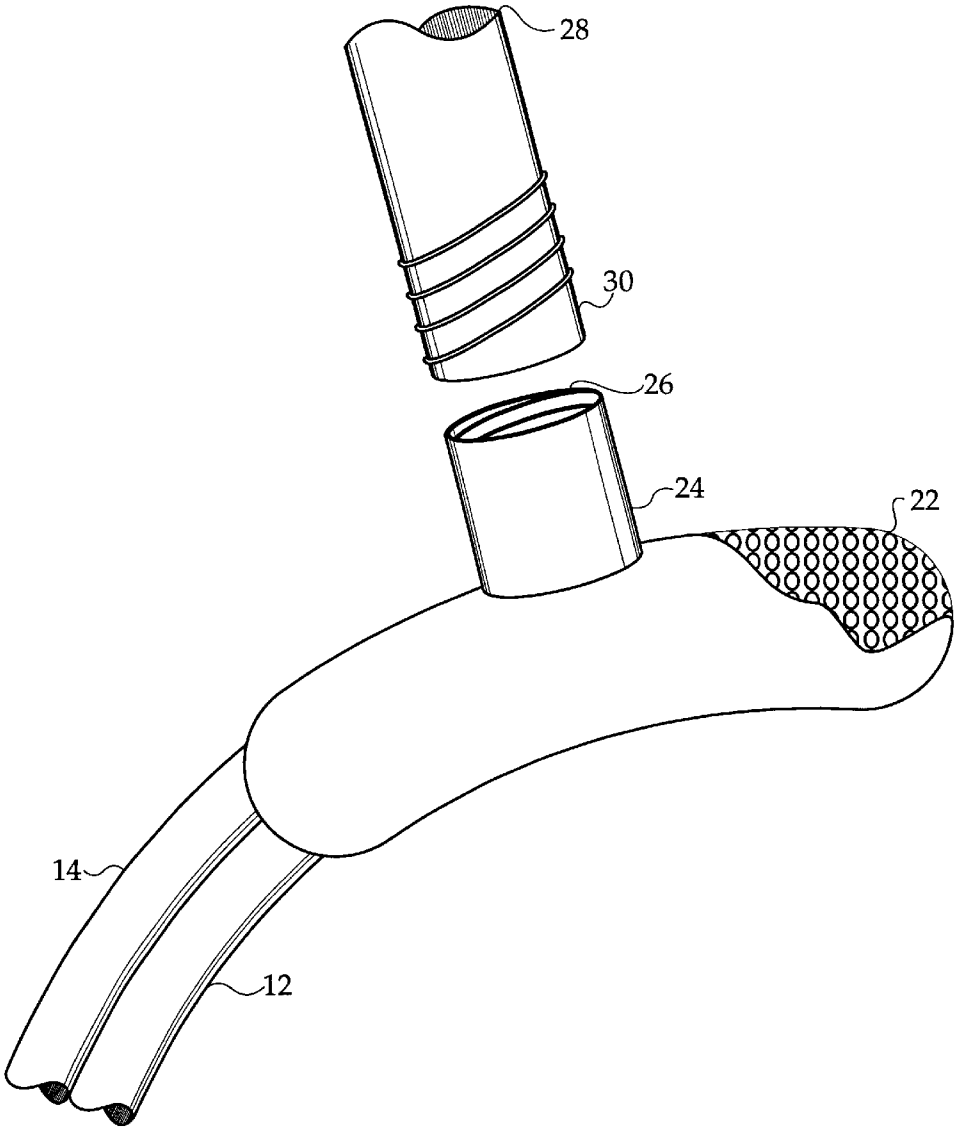
FIG. 3 is a sectional perspective view of the present invention illustrating the handle removed therefrom.
Figure 4:
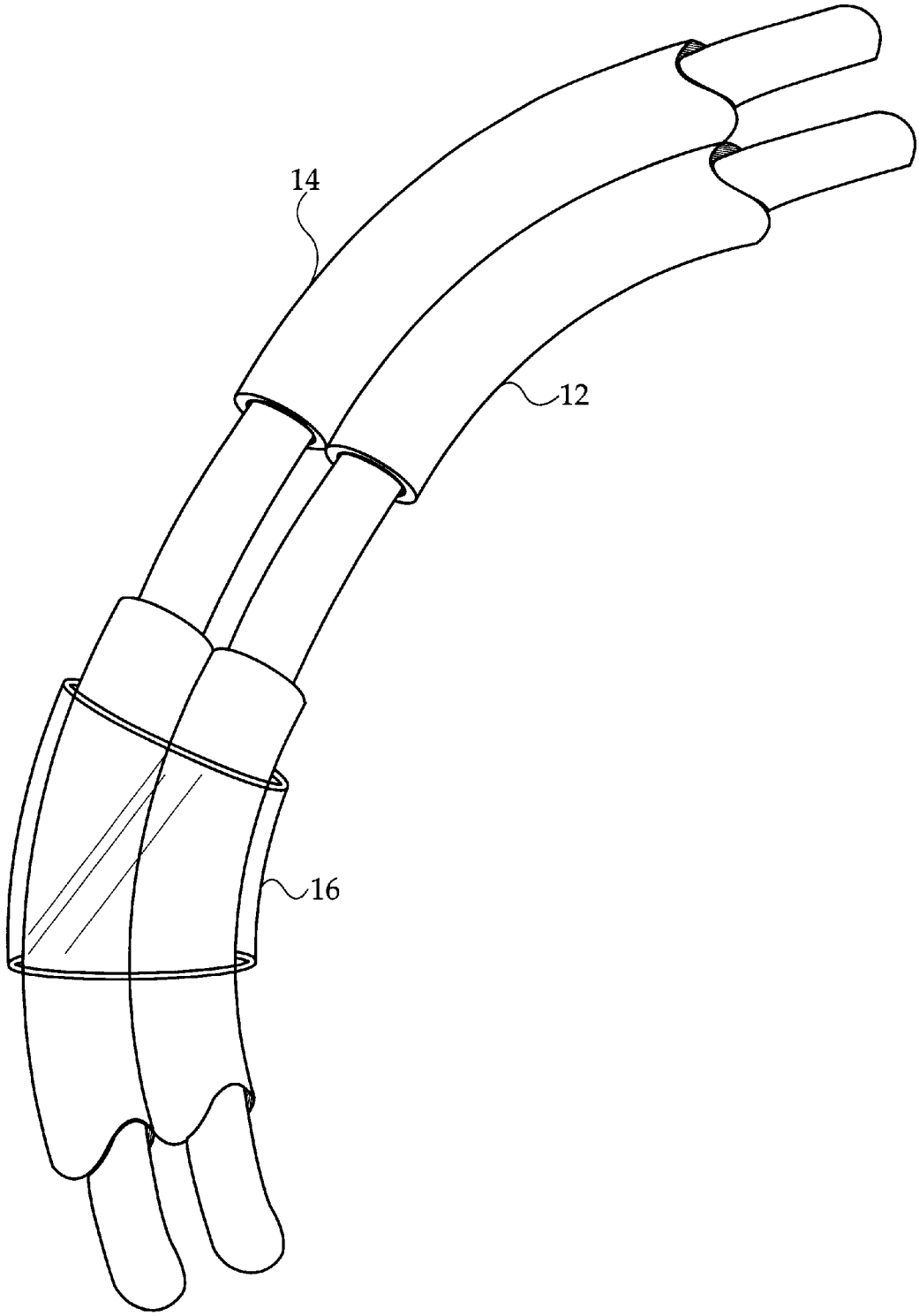
FIG. 4 is a sectional front view of the present invention illustrating the use of the sliding clamp fixing the diameters of the inner and outer hoops.
Figure 5:
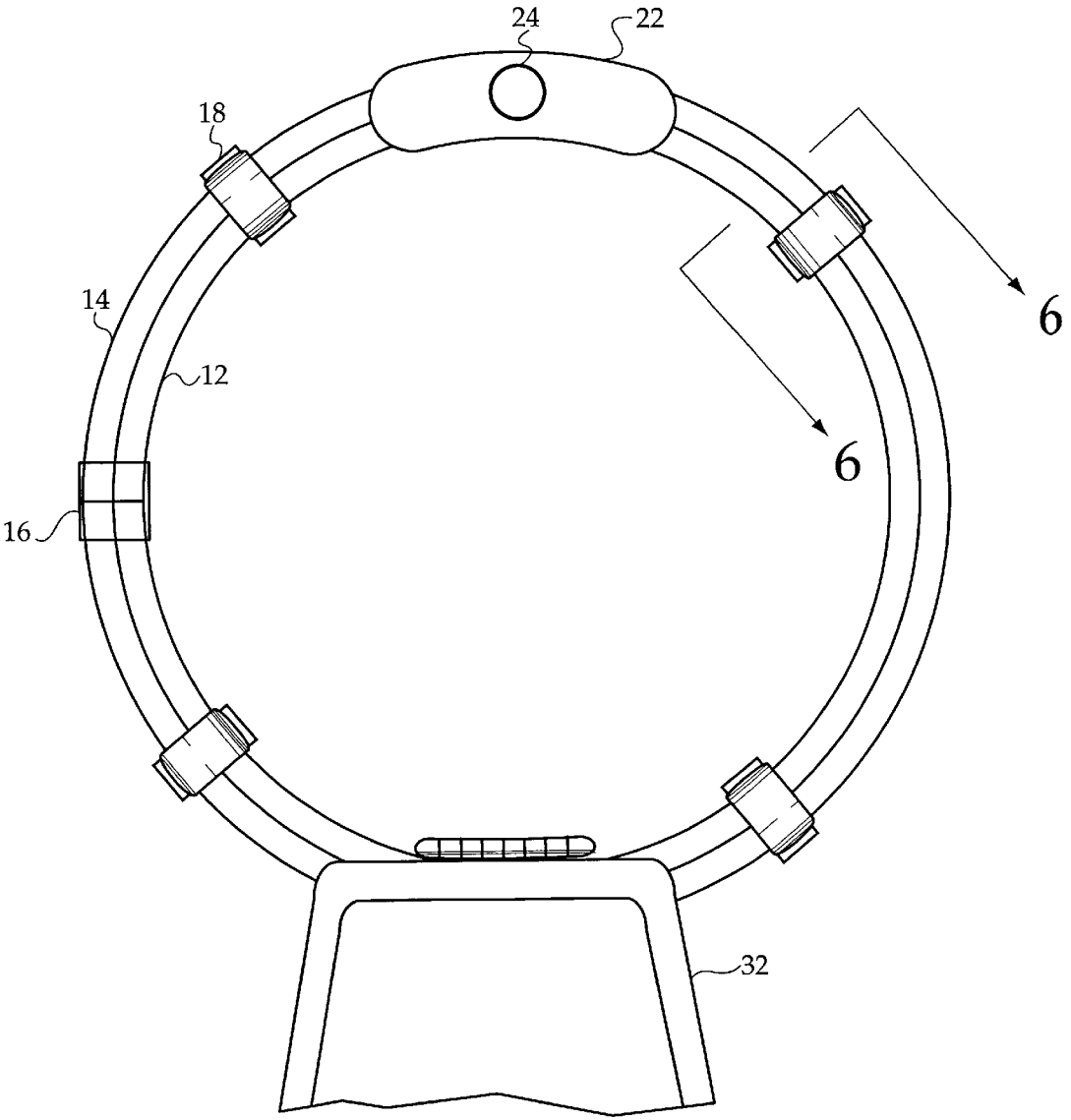
FIG. 5 is a top plan view of the present invention.
Figure 6:
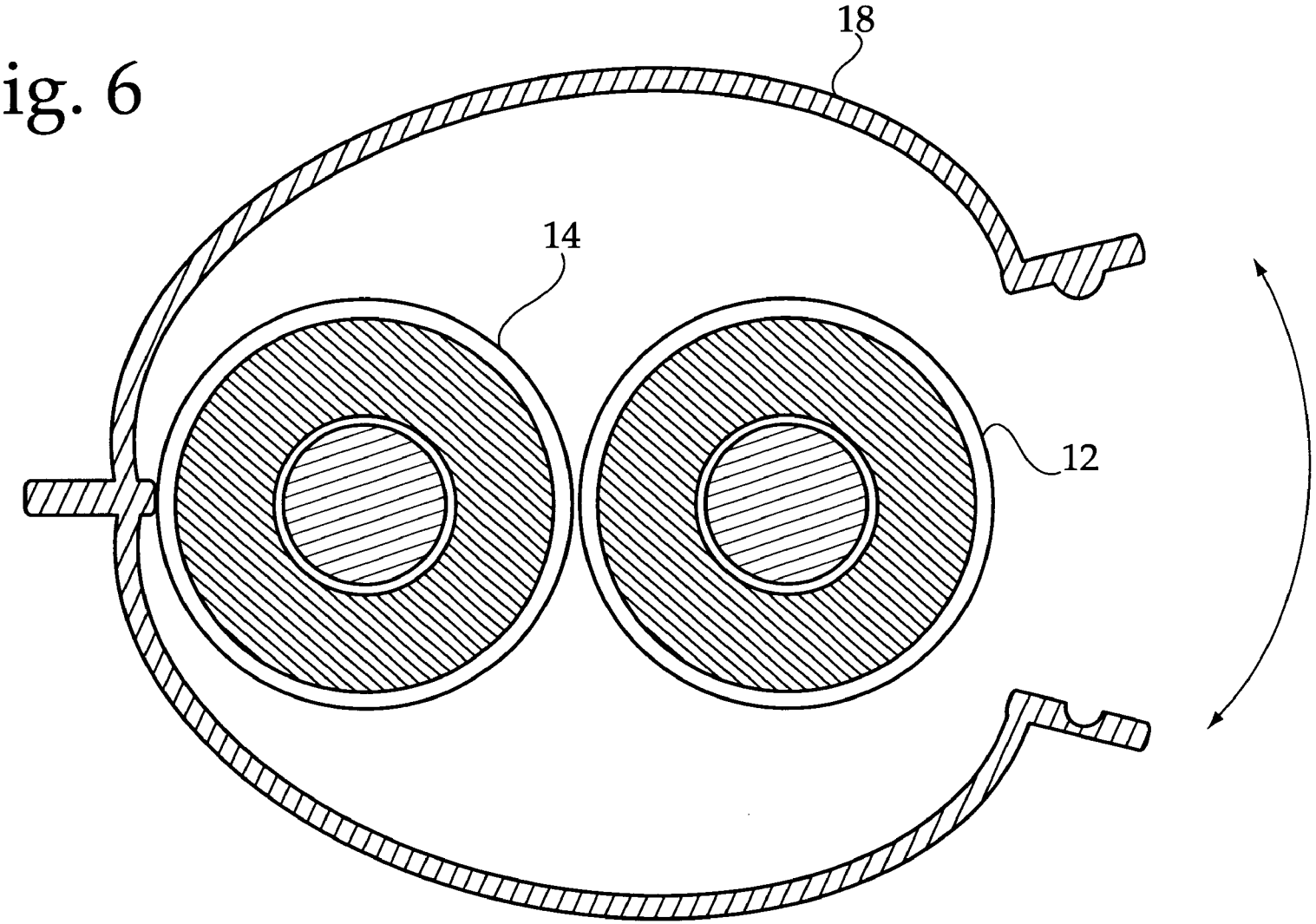
FIG. 6 is a cross-sectional view of the present invention as taken along line 6—6 of FIG. 5.

The pair of hoops includes an inner hoop 12 and an outer hoop 14. The inner hoop 12 is positionable within the outer hoop 14. The pair of hoops are expandable to varying diameters. The pair of hoops have a slide member 16 coupled thereto. The slide member 16 holds the pair of hoops at a fixed diameter. The pair of hoops have a plurality of circumferentially spaced pliable clamps 18 holding the inner and outer hoops 12,14 together. The pair of hoops receive an open upper end of a bag 20 between the inner and outer hoops 12,14. Note FIG. 1.

The gripping member 22 is coupled with the pair of hoops. The gripping member 22 has a cylindrical collar 24 extending laterally therefrom. The cylindrical collar 24 has an internally threaded open upper end 26. The gripping member 22 includes an elongated handle 28 couplable with the cylindrical collar 24. The elongated handle 28 has a threaded lower end 30 for mating with the internally threaded open upper end 26 of the cylindrical collar 24.

The dust pan 32 is hingedly coupled with the pair of hoops. The dust pan 32 is diametrically opposed from the gripping member 22. The dust pan 32 has a free planar lower edge 34 for positioning on a recipient surface.

The present invention allows for floors and the like to be easily cleaned with the use of a broom 36 or other sweeping instrument. The inner and outer hoops 12,14 are first separated to receive the bag 20 therebetween. The diameters of the pair of hoops can be adjusted to accommodate the size of the open upper end of the bag 20. Once the proper size has been reached, the slide collar 16 is positioned to prevent any further expansion of the hoop's 12,14. The pliable clamps 18 are then fixed to the pair of hoops to contain the open upper end of the bag 20 between the inner and outer hoops 12,14. The dust pan 32 can then be lowered for positioning on the ground and the user can hold the elongated handle 28 upwardly to allow debris to be swept into the dust pan 32. After the dust pan 32 has been filled, it can be pivoted upwardly and emptied into the bag 20.

What is claimed is:

1. A bag opening and cleaning system which allows a garbage or leaf bag to be held open while filled with garbage or leaves, comprising, in combination:

a pair of hoops including an inner hoop and an outer hoop, the inner hoop being positionable within the outer hoop, the pair of hoops being expandable to varying diameters, the pair of hoops having a slide member coupled thereto, the slide member holding the pair of hoops at a fixed diameter, the pair of hoops having a plurality of circumferentially spaced pliable clamps holding the inner and outer hoops together, the pair of hoops receiving an open upper end of a bag between the inner and outer hoops;

a gripping member coupled with the pair of hoops, the gripping member having a cylindrical collar extending laterally therefrom, the cylindrical collar having an internally threaded open upper end, the gripping member including an elongated handle couplable with the cylindrical collar, the elongated handle having a threaded lower end for mating with the internally threaded open upper end of the cylindrical collar; and a dust pan hingedly coupled with the pair of hoops, the dust pan being diametrically opposed from the gripping member, the dust pan having a free planar lower edge for positioning on a recipient surface.

2. A bag opening and cleaning system which allows a garbage or leaf bag to be held open while filled with garbage or leaves, comprising, in combination:

a pair of hoops including an inner hoop and an outer hoop, the inner hoop being positionable within the outer hoop, the pair of hoops having a plurality of circumferentially spaced pliable clamps holding the inner and outer hoops together, the pair of hoops receiving an open upper end of a bag between the inner and outer hoops, wherein the pair of hoops are expandable to varying diameters;

a gripping member coupled with the pair of hoops; and a dust pan hingedly coupled with the pair of hoops.

3. The bag opening and cleaning system as set forth in claim 2, wherein the pair of hoops have a slide member coupled thereto, the slide member holding the pair of hoops at a fixed diameter.

4. The bag opening and cleaning system as set forth in claim 2, wherein the gripping member has a cylindrical collar extending laterally therefrom, the cylindrical collar having an internally threaded open upper end, the gripping member including an elongated handle couplable with the cylindrical collar, the elongated handle having a threaded lower end for mating with the internally threaded open upper end of the cylindrical collar.

5. The bag opening and cleaning system as set forth in claim 2, wherein the dust pan is diametrically opposed from the gripping member, the dust pan having a free planar lower edge for positioning on a recipient surface.

* * * * *